US009273496B2

(12) United States Patent
Theobald

(10) Patent No.: US 9,273,496 B2
(45) Date of Patent: Mar. 1, 2016

(54) ANTI-THEFT DEVICES AND METHODS

(76) Inventor: James Theobald, Kingston upon Thames Surrey (GB)

( * ) Notice: Subject to any disclaimer, the term of this patent is extended or adjusted under 35 U.S.C. 154(b) by 0 days.

(21) Appl. No.: 14/122,348

(22) PCT Filed: May 24, 2012

(86) PCT No.: PCT/EP2012/059761

§ 371 (c)(1),
(2), (4) Date: Dec. 18, 2013

(87) PCT Pub. No.: WO2012/160168

PCT Pub. Date: Nov. 29, 2012

(65) Prior Publication Data

US 2014/0157839 A1 Jun. 12, 2014

(30) Foreign Application Priority Data

May 26, 2011 (GB) ..... 1108841.6

(51) Int. Cl.
*H01R 13/62* (2006.01)
*E05B 73/00* (2006.01)
(Continued)

(52) U.S. Cl.
CPC ..... *E05B 73/0005* (2013.01); *A47F 7/024* (2013.01); *E05B 73/0082* (2013.01); *H01R 13/639* (2013.01); *H01R 13/6397* (2013.01); *Y10T 70/5009* (2015.04)

(58) Field of Classification Search
CPC ..... H01R 13/6397
USPC ..... 439/304, 265, 953
See application file for complete search history.

(56) References Cited

U.S. PATENT DOCUMENTS 1,605,904 A * 11/1926 Brunt Vernon Van ..... 439/474
2,892,990 A * 6/1959 Werndl ..... 439/265
3,812,381 A * 5/1974 Guyton ..... H05K 7/142 361/774

(Continued)

FOREIGN PATENT DOCUMENTS

EP 1028212 8/2000
GB 2389143 12/2003

(Continued)

OTHER PUBLICATIONS

International Search Report for PCT/EP2012/059761, Completed by the European Patent Office on Sep. 26, 2012, 4 Pages.

(Continued)

*Primary Examiner* — Neil Abrams
(74) *Attorney, Agent, or Firm* — Brooks Kushman P.C.

(57) ABSTRACT

An anti-theft device, for securing an electronic product during retail display, having a socket for the transmission of power and/or information during normal operation, and a plug for engagement with the socket. The plug has an insertable portion, for insertion into the socket, with a lock to prevent removal while locked. The insertable portion also has a release enabling for withdrawal of the insertable portion. The plug has a control mechanism for holding the lock when the plug is engaged with the socket, the lock can be changed from a locking to release configuration by operation of a security key. The device also includes a flexible attachment for attaching the plug to a fixture. In one case the insertable portion includes a pin with an expandable tip for locking the pin to the socket. The flexible attachment may include conductive wires and be joined to an additional electric connector.

31 Claims, 9 Drawing Sheets

(51) Int. Cl.
*H01R 13/639* (2006.01)
*A47F 7/024* (2006.01)

(56) References Cited

U.S. PATENT DOCUMENTS

| | | | | |
|---|---|---|---|---|
| 4,054,352 | A * | 10/1977 | Rudin | 439/304 |
| 4,083,619 | A * | 4/1978 | McCormick et al. | 439/310 |
| 4,384,758 | A * | 5/1983 | Lee et al. | 439/265 |
| 5,082,453 | A * | 1/1992 | Stutz, Jr. | 439/265 |
| 5,194,013 | A * | 3/1993 | Propp | 439/265 |
| 5,344,329 | A * | 9/1994 | Faller | 439/133 |
| 5,399,093 | A * | 3/1995 | Schneider | H01R 39/64 439/21 |
| 5,480,318 | A * | 1/1996 | Garrison | 439/346 |
| 5,865,630 | A * | 2/1999 | Nakano | H01R 12/523 439/48 |
| 6,146,180 | A * | 11/2000 | Betker et al. | 439/352 |
| 6,196,857 | B1 | 3/2001 | Fong | |
| 6,212,922 | B1 | 4/2001 | Miao | |
| 6,297,963 | B1 | 10/2001 | Fogle | |
| 6,663,410 | B2 * | 12/2003 | Revis | 439/348 |
| 6,790,070 | B1 | 9/2004 | England, II | |
| 6,848,926 | B2 * | 2/2005 | Ling et al. | 439/304 |
| 6,902,437 | B1 * | 6/2005 | Wang | 439/668 |
| 6,953,353 | B2 * | 10/2005 | Lemkuil | 439/133 |
| 6,962,498 | B2 * | 11/2005 | Kohen | 439/21 |
| 6,986,678 | B1 * | 1/2006 | Di-Nardo et al. | 439/372 |
| 7,160,137 | B1 * | 1/2007 | Yeh | 439/358 |
| 7,435,090 | B1 * | 10/2008 | Schriefer et al. | 439/13 |
| 7,972,160 | B2 * | 7/2011 | Jeong | H01R 31/06 439/304 |
| 8,033,853 | B2 * | 10/2011 | Chang | 439/304 |
| 8,408,932 | B2 * | 4/2013 | Villarreal et al. | 439/358 |
| 8,449,311 | B2 * | 5/2013 | Montena | H01R 13/639 439/265 |
| 8,477,505 | B2 * | 7/2013 | Samuels et al. | 361/728 |
| 8,782,869 | B2 * | 7/2014 | Dolci et al. | 29/426.6 |
| 8,845,356 | B2 * | 9/2014 | Cheatham et al. | 439/357 |
| 2005/0157460 | A1 | 7/2005 | Bhogal et al. | |
| 2007/0245777 | A1 | 10/2007 | Miao | |
| 2007/0277566 | A1 | 12/2007 | Yu | |
| 2008/0045069 | A1 | 2/2008 | Haren | |
| 2009/0221188 | A1 | 9/2009 | Gao et al. | |
| 2010/0300158 | A1 | 12/2010 | Andres et al. | |
| 2014/0157839 | A1 * | 6/2014 | Theobald | 70/58 |

FOREIGN PATENT DOCUMENTS

| | | |
|---|---|---|
| GB | 2404416 | 2/2005 |
| WO | 03028166 | 4/2003 |
| WO | 2008021042 | 2/2008 |
| WO | 2009069188 | 6/2009 |

OTHER PUBLICATIONS

Search Report for GB 1108841.6, Dated Sep. 12, 2011, 2 Pages.
Search Report for GB 1309246.5, Dated Dec. 11, 2013, 1 Page.

* cited by examiner

ANTI-THEFT DEVICES AND METHODS

CROSS-REFERENCE TO RELATED APPLICATION

This application is the U.S. national phase of PCT Application No. PCT/EP2012/059761 filed on May 24, 2012, which claims priority to Great Britain Patent Application No. 1108841.6 filed on May 26, 2011, the disclosures of which are incorporated in their entirety by reference herein.

The invention relates to anti-theft devices, methods of securing portable electronic products against theft during retail display, and assemblies comprising an anti-theft device and a portable electronic product.

It is desirable to allow potential purchasers to handle and operate portable electronic products on display during retail sale, while avoiding theft of the products. For mobile telecommunications handsets, such as smart phones, a known anti-theft device comprises a metal cradle and a wire attaching the cradle to a display fixture. The cradle fits around and securely holds the handset. The wire allows a potential purchaser to pick up and operate the handset while the handset is held by the cradle and anchored to the fixture by the wire. However, the use of such a cradle has a number of disadvantages. Firstly, as the cradle fits around the handset, it may impede operation of the handset and prevents the potential purchaser from assessing the weight and feel of the handset. Secondly, to ensure that the cradle holds the handset securely, the cradle must be closely matched to the shape of the handset and this requires a number of cradles of different designs to hold different designs of handset.

According to a first aspect of the invention, there is provided an anti-theft device for securing during retail display an electronic product having a socket adapted for the transmission of power and/or information during normal operation of the electronic product, the anti-theft device comprising: a plug for engagement with the socket, the plug having an insertable portion for insertion into the socket, the insertable portion having a locking configuration for locking of the insertable portion within the socket to prevent removal of the insertable portion from the socket while the insertable portion is in the locking configuration and a release configuration for withdrawal of the insertable portion from the socket, the plug having a control mechanism for holding the insertable portion in the locking configuration such that when the plug is engaged with the socket the configuration of the insertable portion can be changed from the locking configuration to the release configuration substantially only by operation of the control mechanism by a security key; and a flexible attachment for attaching the plug to a fixture.

The plug can be relatively small and lightweight and does not need to fit around the electronic product. This may help a purchaser to assess the weight and feel of the electronic product and may allow the controls of the electronic product to remain unobstructed. The use of a socket that fulfils a purpose in the product after sale avoids the need to provide the product with an extra socket dedicated to securing the product during display.

The term "flexible attachment" covers both an attachment that is substantially uniformly flexible along its length and also an attachment that is not uniformly flexible but which allows the electronic product to be picked up and handled during retail display. For example, a flexible attachment may take the form of a cable with a braided metal sheath which imparts strength to the attachment while allowing a substantially uniform flexibility along the length of the attachment. A flexible attachment that is not uniformly flexible may, for example, comprise strong rigid members connected together so as to allow overall flexibility of the attachment. For example, the rigid members could be links of a chain. A flexible attachment may include rigid components such as a socket housing or a mount for mounting the flexible attachment to a fixture.

The requirement for a security key means that the configuration of the insertable portion cannot be changed from the locking configuration to the release configuration, while the plug is locked in the socket, by a screwdriver having a commonplace slot or cross-head tip. Such a screwdriver cannot be used to operate the control mechanism. Preferably the security key and the plug have corresponding mating formations, which may be bespoke or at least not commonplace, and by which the plug can be operated by the security key to release the plug from the socket. The plug may be susceptible to removal from the socket by brute force or by methods which involve damaging or dismantling the electronic product but this is acceptable as it would generally be noticed in the showroom.

Preferably, the control mechanism includes a locking member moveable between a locking position and a release position. The locking member locks the insertable portion in the locking configuration when the locking member is in the locking position. In this case, the locking member can be a screw having a formation for cooperation with the security key to allow the security key to exert a torque on the screw for movement of the screw between the locking and release positions.

When a locking member is provided, movement of the locking member to the locking position may cause expansion of the insertable portion so that the insertable portion becomes locked within the socket by jamming.

According to a second aspect of the invention, there is provided a kit comprising an anti-theft device according to the first aspect of the invention and a security key for operating the control mechanism.

According to a third aspect of the invention, there is provided an assembly comprising an anti-theft device according to the first aspect of the invention and an electronic product having a socket adapted for the transmission of power and/or information during normal operation of the electronic product. The insertable portion of the plug is lockable within the socket.

According to a fourth aspect of the invention, there is provided a method of securing against theft during retail display a portable electronic product comprising: providing a portable electronic product having a socket adapted for the transmission of power and/or information during normal operation of the electronic product; engaging a plug with the socket; operating the plug to lock the plug in the socket; the plug being attached by a flexible attachment to a retail display fixture. Preferably, when the plug is locked in the socket, the plug can be withdrawn from the socket substantially only by operating the plug with a security key.

In a preferred embodiment of the fourth aspect of the invention, the plug has an insertable portion for insertion into the socket. The insertable portion has a locking configuration for locking of the insertable portion within the socket to prevent removal of the insertable portion from the socket while the insertable portion is in the locking configuration. The insertable portion also has a release configuration for withdrawal of the insertable portion from the socket. The operation of the plug to lock the plug in the socket comprises changing the configuration of the insertable portion from the release configuration to the locking configuration. In addition, the plug may have a control mechanism for holding the insertable portion in the locking configuration such that when the plug is engaged with the socket the configuration of the insertable portion can be changed from the locking configuration to the release configuration substantially only by operation of the control mechanism by a security key. In this case, the aforementioned operation of the plug to lock the plug in the socket comprises operating the control mechanism with the security key to change the configuration of the insertable portion from the release configuration to the locking configuration.

According to a fifth aspect of the invention, there is provided an assembly comprising: a portable electronic product having a socket adapted for the transmission of power and/or information during normal operation of the electronic product; a plug engageable with the socket, the plug being operable to lock the plug in the socket; and a flexible attachment for attaching the plug to a fixture. Preferably, when the plug is locked in the socket the plug can be withdrawn from the socket substantially only by operating the plug with a security key.

In a preferred embodiment of the fifth aspect of the invention, the plug has an insertable portion for insertion into the socket. The insertable portion has a locking configuration for locking of the insertable portion within the socket to prevent removal of the insertable portion from the socket while the insertable portion is in the locking configuration. The plug also has a release configuration for withdrawal of the insertable portion from the socket. In addition, the plug may have a control mechanism for holding the insertable portion in the locking configuration such that when the plug is engaged with the socket the configuration of the insertable portion can be changed from the locking configuration to the release configuration substantially only by operation of the control mechanism by a security key.

In all aspects of the invention, the socket is preferably a standard socket which, in the normal operation of the electronic product, serves for one or more functions selected from the group consisting of: charging the electronic product; transmitting information into the electronic product; transmitting information out of the electronic product; and powering the electronic product. Many different electronic products use such standard sockets. Hence the use of a socket of standard type allows the plug to be engaged with a wide range of different electrical products and there is no need to provide plugs specially adapted for particular products. By way of example, the socket of any aspect of the invention may be a jack socket, a USB socket, a memory card socket, a battery socket, a charging socket, or a power cable socket.

The term "USB socket" includes any type of USB socket of any USB specification and any configuration, and in particular includes USB sockets of USB 1.0, 2.0 and 3.0 specifications, and USB sockets of Type A, Type B, Mini-A, Mini-B, Micro-A and Micro-B.

The term "jack plug" is used to signify an electrical male plug having a single generally cylindrical pin provided with a plurality of contact areas along its length and the term "jack socket" is used to signify the corresponding female socket. Jack plugs are also commonly known as audio jacks or phone jacks. The term jack plug includes all sizes (eg with 2.5 mm, 3.5 mm and 6.35 mm diameter pins). The term jack plug also covers plugs with any plural number of contacts. For example, a stereo output plug commonly has three contacts and is often referred to as a TRS plug (the initials TRS referring to the three contact areas of the pin known as Tip, Ring and Sleeve). An audio mono output plug commonly has two contacts and is often referred to as a TS (Tip, Sleeve) plug. A four contact plug is commonly referred to as a TRRS (Tip, Ring, Ring, Sleeve) plug. Jack plugs having greater numbers of contacts are available. All such plugs are included within the term jack plug and the corresponding sockets are included within the term jack socket. The terms jack plug and jack socket are not limited to audio out plugs/sockets and also cover all other uses, such as a microphone plug having a cylindrical configuration and the corresponding socket.

In all aspects of the invention, the electronic product may be a mobile telecommunications handset, a portable computing device, or a portable player of digital media.

In all aspects of the invention, the plug and the flexible attachment may charge and/or power the electronic product via the socket. Alternatively, or in addition, the plug may transmit information into and/or out of the electronic product via the socket. In especially preferred embodiments, the plug receives an electrical audio signal from the socket of the electronic product and the electrical audio signal is conveyed to an audio output socket provided on the plug or on the flexible attachment by electrical conductors.

The following is a more detailed description of anti-theft devices in accordance with the invention, by way of example, reference being made to the appended schematic drawings in which.

Figure 1:
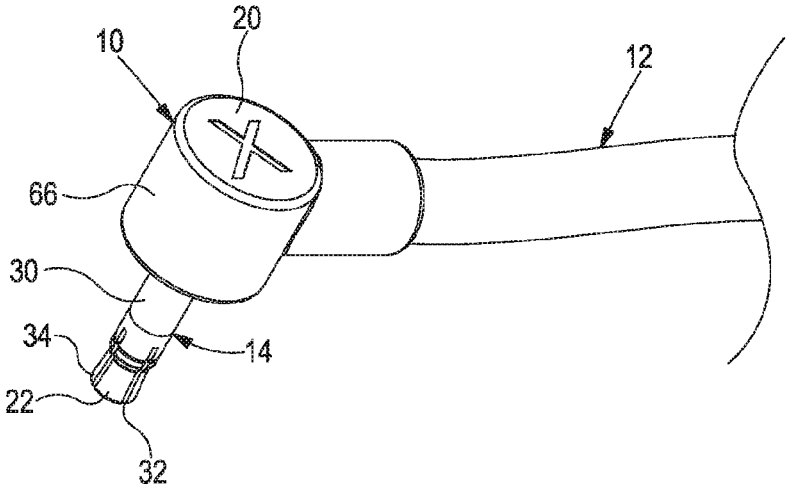
FIG. 1 is a perspective view of a first anti-theft device comprising a plug and a flexible attachment cable.

Referring first to FIGS. 1 to 3 and 7, the first anti-theft device comprises a plug 10 and a flexible attachment cable 12. The plug 10 is, in this example, a 3.5 mm diameter TRS stereo-out jack plug. However, as described below in more detail, the jack plug 10 has a locking function not found in standard jack plugs.

The jack plug 10 comprises a pin 14, a body 16, a locking screw 18 and a cap 20.

As for a standard TRS jack plug, the jack plug 10 has three electrical contacts. Starting from the outer end, the pin 14 has a conductive tip 22, a first insulator 24, a conductive ring 26, a second insulator 28 and a conductive sleeve 30. The conductive tip 22 forms a contact which carries the stereo left-hand signal. The conductive ring 26 acts as a contact which carries the stereo right-hand signal. The conductive sleeve 30 acts as the ground contact. The pin has a threaded cylindrical opening 31 running coaxially with the pin 14 from the first insulator 24 to the body 16.

Figure 2:
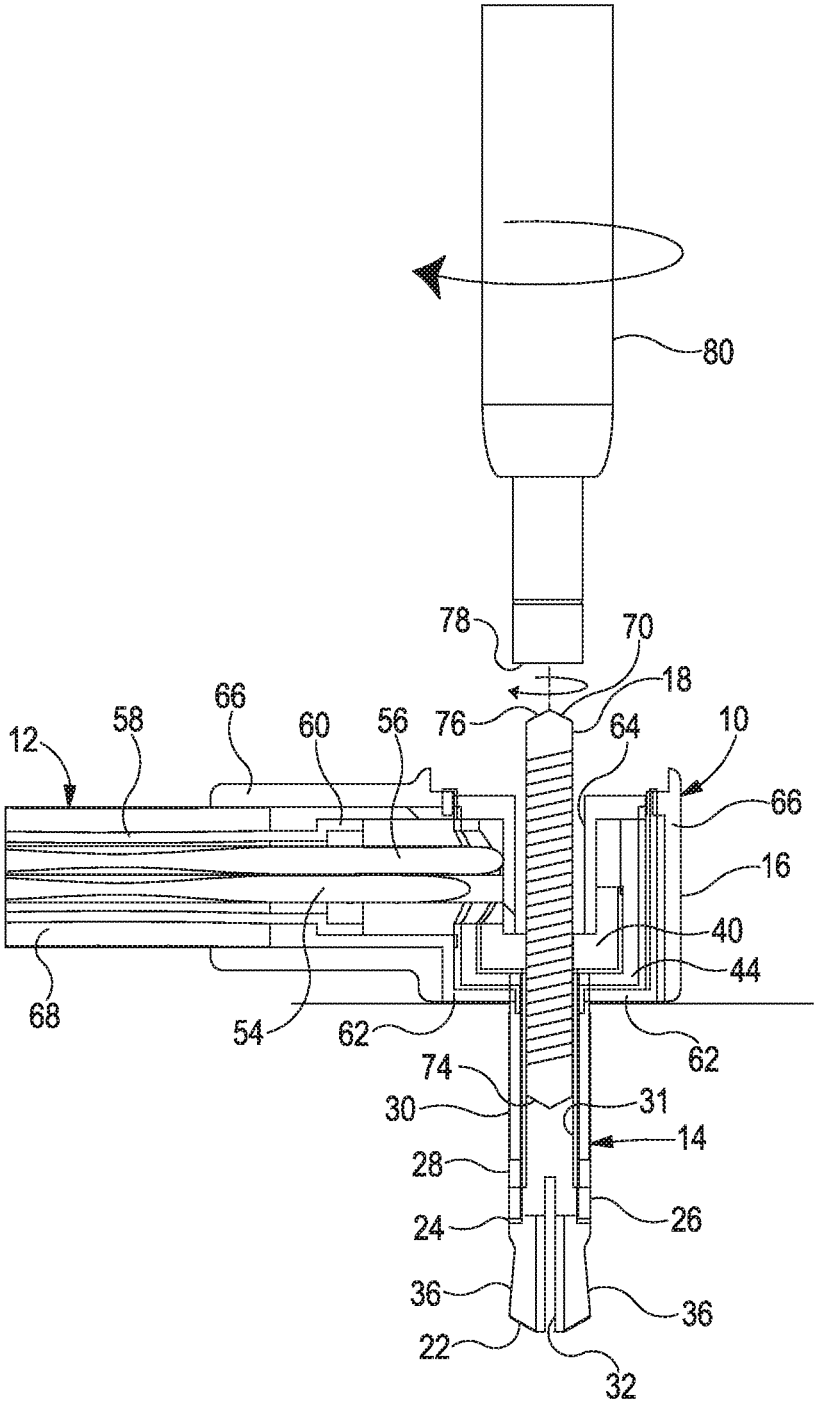
FIG. 2 is a view, partially in cross-section, of the anti-theft device of FIG. 1 showing the plug in a release configuration and also showing a security key.

As seen, for example in FIGS. 1 and 2, two intersecting slots 32, 34 extend inwardly into the pin 14 from the outer end of the pin 14. The slots 32, 34 divide a region of the pin 14 consisting of the tip 22, the first insulator 24 and the ring 26 into four flexible fingers 36.

Figure 4:
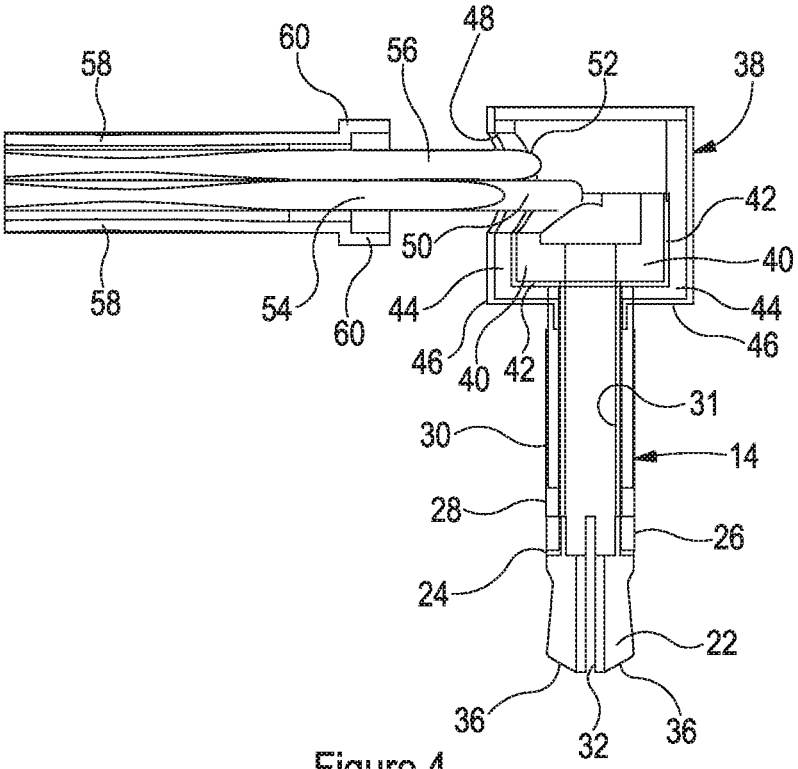
FIG. 4 is a cross-sectional view showing a first stage in the manufacture of the anti-theft device of FIGS. 1 to 3.

The structure of the body 16 is best described with reference to FIGS. 4 to 6 which show consecutive stages in the manufacture of the jack plug 10. Referring first to FIG. 4, the body 16 of the jack plug 10 has a core 38 which, starting from the inside and working out, is formed by an inner conductor 40, an inner insulator 42, an outer conductor 44, and an outer insulator 46. As seen in FIG. 4, the inner insulator 42 separates the inner conductor 40 from the outer conductor 44. The inner conductor 40 is connected via a conductive track (not shown) to the tip 22 of the pin 14. The outer conductor 44 is connected via a conductive track (not shown) to the ring 26 of the pin 14.

As seen in FIG. 4, the core 38 is provided with a side opening 48 having a first socket 50 and a second socket 52. The first socket 50 opens to the inner conductor 40 but is insulated from the outer conductor 44. Conversely, the second socket 52 opens to the outer conductor 44 but is insulated from the inner conductor 40.

FIG. 4 also shows the internal structure of the flexible attachment cable 12. The flexible attachment cable 12 has a first insulated core wire 54 and a second insulated core wire 56. The first and second core wires 54, 56 are surrounded by a heavy duty braided metal sheath 58. When assembled, the first core wire 54 enters into the first socket 50 so as to form an electrical connection with the inner conductor 40 of the core 38. In this way, the first core wire 54 is electrically connected to the tip 22 of the pin 14 and carries the stereo left hand signal. The second core wire 56 enters into the second socket 52 so as to be in electrical connection with the outer conductor 44 of the core 38. In this way, the second core wire 56 is electrically connected with the ring 26 of the pin 14 and so carries the stereo right hand signal.

(Simply for the purposes of illustration, the first core wire 54 is shown in FIG. 4, and also in FIGS. 5, 6, 2 and 3, only partially inserted into the first socket 50, although, when fully assembled, the first core wire 54 will be fully inserted into the first socket 50 to achieve electrical connection with the inner conductor 40.)

The braided metal sheath 58 is attached to an electrical connector 60 which has a shoulder for a purpose to be described below.

Figure 5:
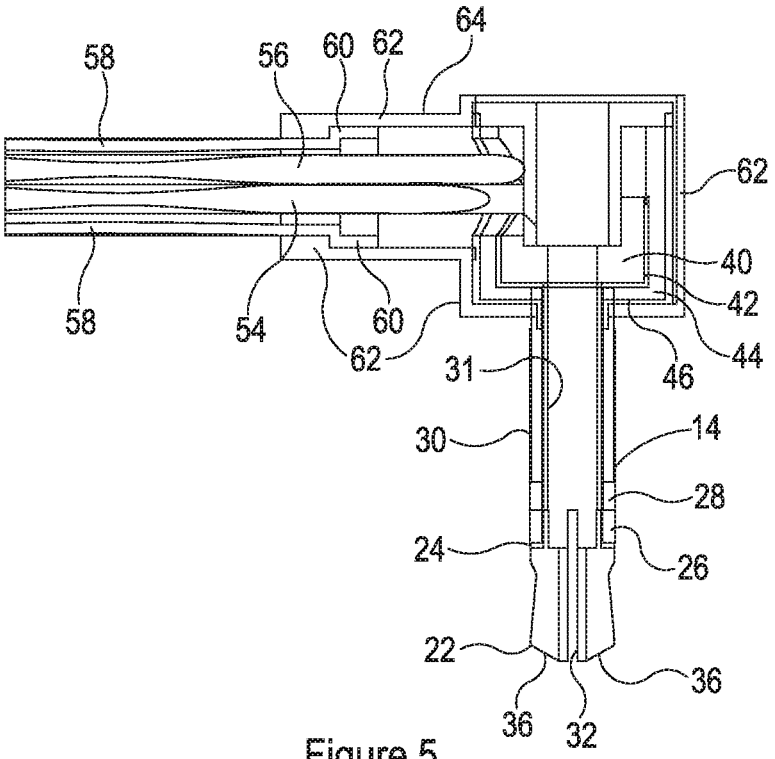
FIG. 5 is a cross-sectional view of a second stage in the manufacture of the anti-theft device of FIGS. 1 to 4.

Turning now to FIG. 5, the core 38 is surrounded by an inner metal housing 62. The inner metal housing 62 has a housing projection 64 also formed with a shoulder. The shoulder of the housing projection 64 engages with the shoulder of the electrical connector 60 so as to hold the electrical connector 60 in proximity to the core 38 with the first core wire 54 inserted in the first socket 50 in the second core wire 56 inserted in the second socket 52. The inner metal housing 62 also forms a conductive pathway between the sleeve 30 of the pin 14 and the electrical connector 60 of the flexible attachment cable 12. In this way, the braided metal sheath 58 acts as the ground within the flexible attachment cable 12.

Figure 6:
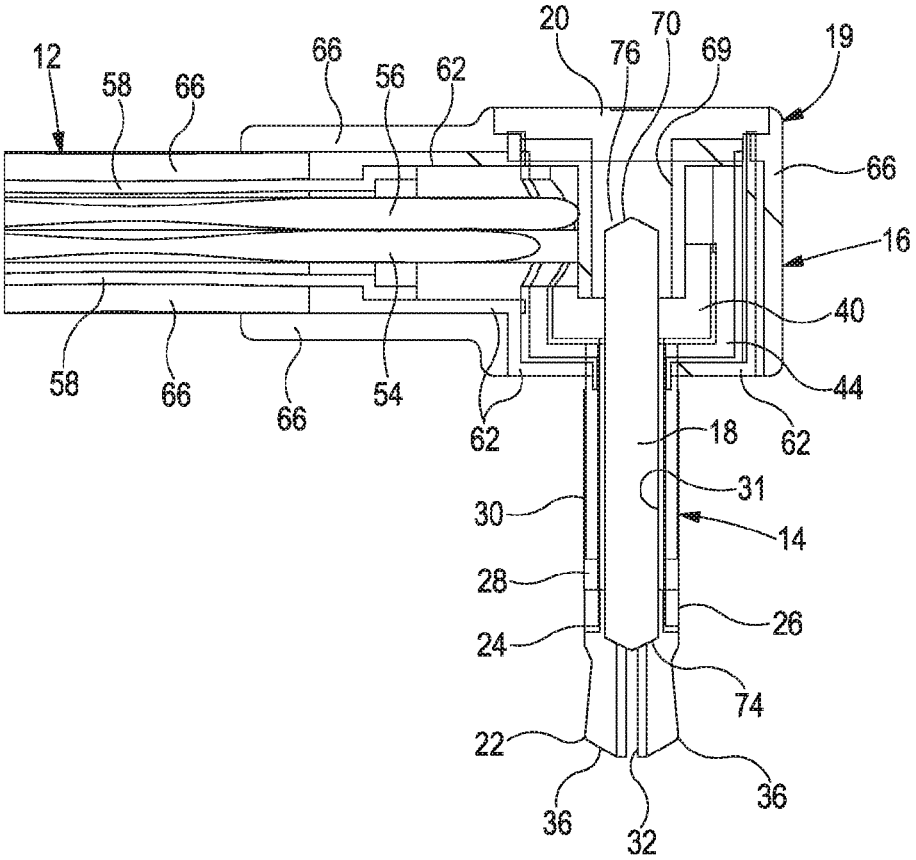
FIG. 6 is a cross-sectional view showing a third stage in the manufacture of the anti-theft device of FIGS. 1 to 5.

As seen in FIG. 6, the inner metal housing 62 is surrounded by a tough outer insulating housing 66. The outer insulating housing 66 is bonded to a tough outer insulating sheath 68 which forms the outer layer of the flexible attachment cable 12. The bond between the outer insulating housing 66 and the outer insulating sheath 68 is very strong which makes it very difficult to separate the jack plug 10 from the flexible attachment cable 12.

As seen in FIG. 6, the body 16 of the jack plug 10 has a cylindrical opening 69 which is continuous and coaxial with the threaded cylindrical opening 31 of the pin 14.

Figure 3:
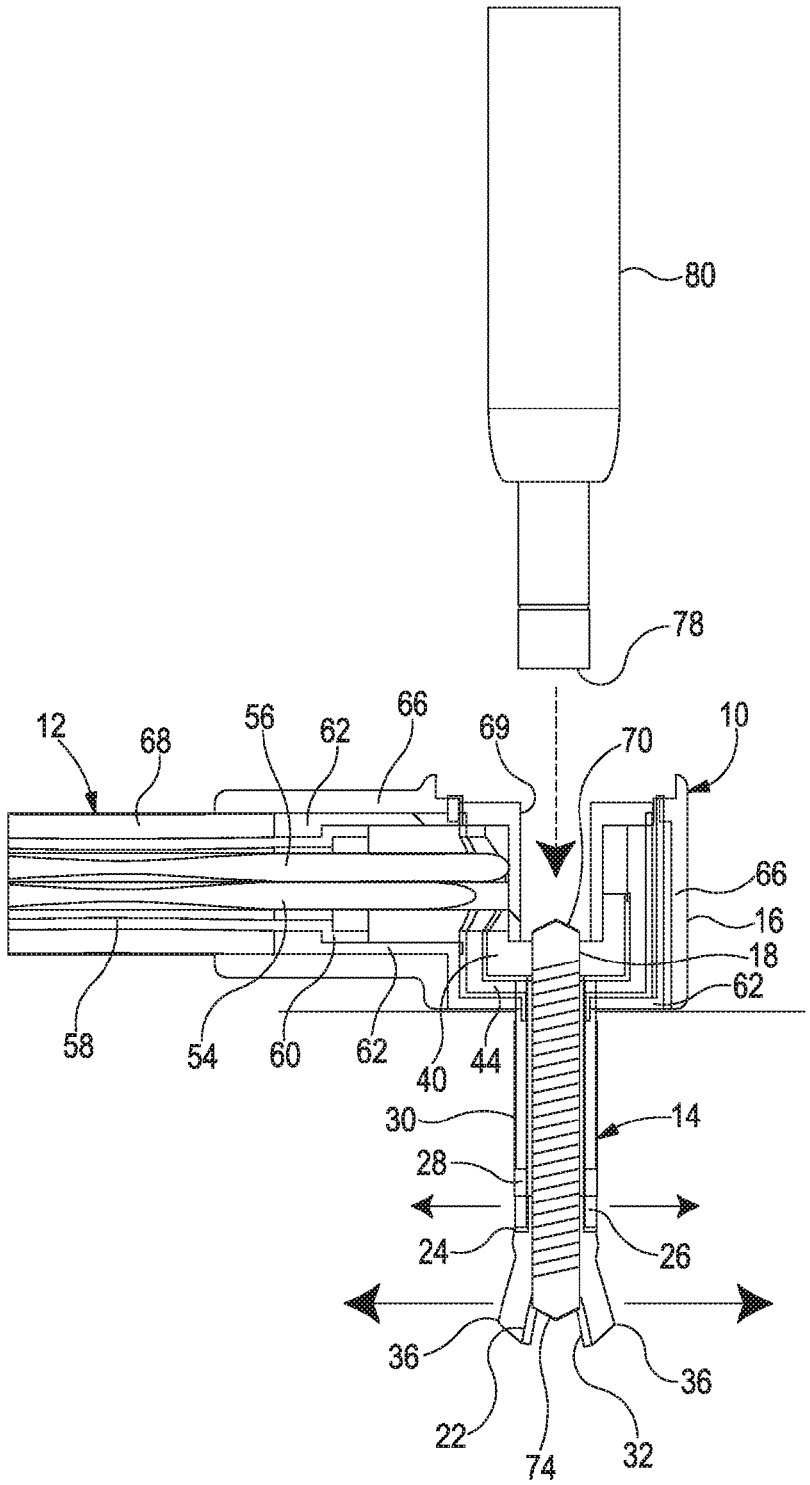
FIG. 3 is a view, partially in cross-section, of the anti-theft device of FIGS. 1 and 2, showing the plug in a locking configuration and also showing the security key.

Referring now to FIGS. 2, 3 and 6, the locking screw 18 is a headless screw which is engaged with the screw thread of the cylindrical opening 31 in the interior of the pin 14. As seen in FIGS. 3 and 6, a first end 70 of the locking screw 18 lies, in normal operation, in the cylindrical opening 69 in the body 16. A second end 74 of the locking screw 18 lies within the pin 14. The first end 70 of the locking screw 18 is formed with a security formation 76 which cooperates with a corresponding security formation 78 provided on a security key 80. In this particular example, the security formation 76 on the locking screw 18 is pyramidal in shape. The cooperating security formation 78 on the security key 80 takes the form of a pyramidal recess. In this way, the security formation 76 on the locking screw 18 can cooperate with the security formation 78 on the security key 80 so as to allow the security key 80 to apply a torque to the locking screw 18 for rotation of the locking screw 18. Rotation of the locking screw 18 in one sense causes the second end 74 of the locking screw 18 to progress towards the outer end of the pin 14. Rotation of the locking screw 18 in the other sense causes the second end 74 of the locking screw 18 to progress away from the outer end of the pin 14 towards the body 16.

The shape of the security formation 76 on the first end 70 of the locking screw 18 makes it impossible to rotate the locking screw 18 with a screwdriver having a conventionally shaped head, such as a slot head or a cross-head. It will be appreciated that the same advantage may be achieved using different shapes for the security formation 76 of the locking screw 18. In many cases, it will be desirable for the security formation 76 on the locking screw 18 to be a positive shape (that is to say convex rather than concave) as this makes it harder to rotate the locking screw 18 with a screwdriver with a standard head.

The security formation 76 on the locking screw 18 fits closely within the cylindrical opening 69 of the body 16. This is advantageous because it makes it impossible to rotate the locking screw 18 with a pair of long nosed pliers.

As shown in FIGS. 2, 3 and 6, the pin 14 has two different configurations, dependent on the position of the locking screw 18. In FIG. 3, the locking screw 18 is in a locking position. The second end 74 of the locking screw 18 lies within the tip 22 of the pin 14. In this locking position, the locking screw 18 bears against the fingers 36 of the pin 14 causing the fingers 36 to splay away from one another, and thereby expand the tip 22. This constitutes a locking configuration of the pin 14. In FIG. 6, the locking screw 18 is in a release position, being located further into the body 16 and away from the tip 22 of the pin 14. (Another release position of the locking screw 18 is shown in FIG. 2). When the locking screw 18 is in a release position, the locking screw 18 does not bear against the fingers 36 and the fingers 36 assume their natural unbiased position with the fingers 36 lying close together. This constitutes a release configuration of the pin 14.

The cap 20 is shown in FIGS. 1 and 6. The cap 20 is provided with a screw thread (not shown) which engages with a corresponding screw thread (not shown) provided in the outer insulating housing 66 of the body 16. The cap 20, when screwed into the outer insulating housing 66, prevents both access to and inspection of the locking screw 18. As seen in FIG. 1, the outer surface of the cap 20 has a formation in the form of two crossed grooves by which the cap 20 can be unscrewed by a normal screwdriver.

Figure 7:
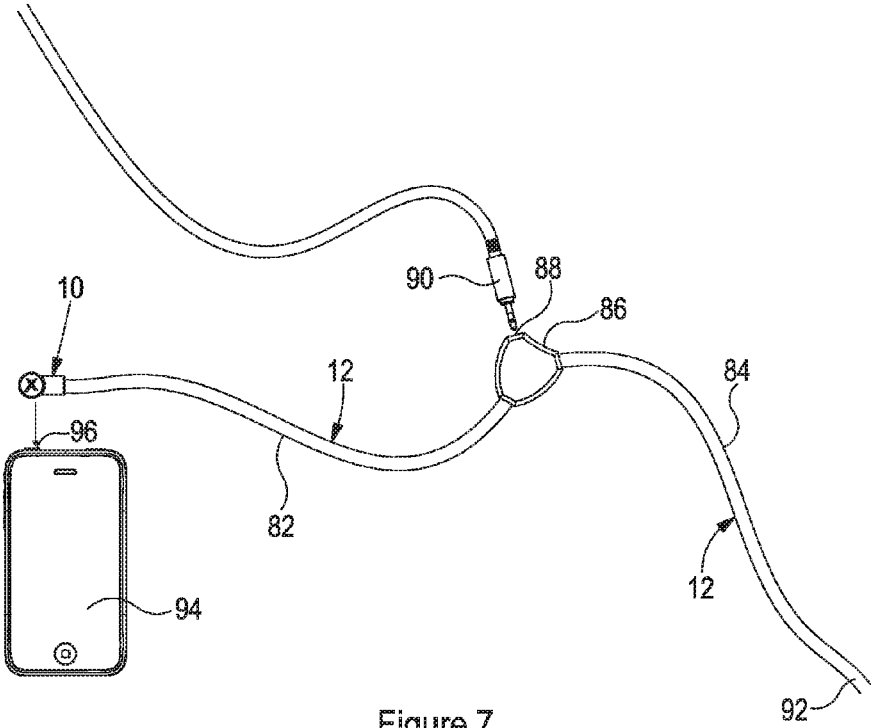
FIG. 7 shows the anti-theft device of FIGS. 1 to 6 together with a mobile telecommunications handset and also together with a lead for a pair of head-phones.

The flexible attachment cable 12 is shown in more detail in FIG. 7. The flexible attachment cable 12 consists of a first cable portion 82 and second cable portion 84. The first and second cable portions 82, 84 are connected by a connector 86. The connector 86 has a socket 88 for receiving a standard audio-out jack plug 90.

As already described with reference to FIGS. 4, 5 and 6, the first cable portion 82 consists of the first and second core wires 54, 56 which are surrounded by the heavy duty braided metal sheath 58, with the tough outer insulating sheath 68 forming the outer layer. The first cable portion 82 is firmly attached to the connector 86. The first core wire 54, the second core wire 56 and the heavy duty braided metal sheath 58 are connected to the jack socket 88 in the connector 86 so that electrical audio signals received by the jack plug 10 are transmitted along the first cable portion 82 to the jack socket 88 of the connector 86.

The heavy duty braided metal sheath 58, in addition to acting as the ground, also provides the first cable portion 82 with a considerable degree of physical strength and resists cutting of the first cable portion 82. The second cable portion 84 does not need to transmit electrical signals. However, the second cable portion 84 should also be physical strong and resistant to cutting. In order to achieve this the second cable portion 84 may use a heavy duty braided metal sheath surrounded by a tough outer non conductive sheath.

As seen in FIG. 7, the second cable portion 84 has a free end 92. In use, the free end 92 may be connected to a mount, for example a mounting plate, so as to allow the flexible attachment cable 12 to the firmly attached to a fixture in a retail showroom.

The operation of the first anti-theft device is now described.

Firstly, the free end 92 of the flexible attachment cable 12 is firmly attached to a fixture, such as a retail display stand. The precise mode of attachment is not important although the attachment must be resistant to removal of the flexible attachment cable 12 from the fixture by customers.

The anti-theft device is used to secure an electronic product 94 during retail display of the electronic product 94. The anti-theft device may be used to secure electronic products such as mobile telecommunication handsets, as well as portable computing devices and portable digital media players. In FIGS. 2, 3 and 7, the anti-theft device is shown in use to secure a mobile telecommunications handset 94. The mobile telecommunications handset 94 has a standard 3.5 mm jack socket for outputting an audio signal from the handset 94.

In order to secure the handset 94, the pin 14 of the jack plug 10 is first configured in the release configuration shown in FIG. 2 by screwing the locking screw 18 away from the tip 22 using the security key 80. This requires removal of the cap 20 to allow access to the locking screw 18. In this release configuration, the fingers 36 are not splayed by the locking screw 18. The pin 14 is then inserted into the jack socket 96 of the mobile telecommunications handset 94. Once the pin 14 is fully inserted in the socket 96, the security key 80 is used to rotate the locking screw 18 so that the second end 74 of the locking screw 18 moves towards and into the tip 22 of the pin 14. As the second end 74 of the locking screw 18 moves into the tip 22, the fingers 36 become splayed outwardly so as to expand the tip 22 and jam the tip 22 within the jack socket 96 of the mobile telecommunications handset 94. The cap 20 is then replaced.

The pin 14 is now in its locking configuration and is locked within the jack socket 96. In this locking configuration, the pin 14 cannot be readily removed from the jack socket 96 and so the mobile telecommunications handset 94 is secured via the plug 10 and the flexible attachment cable 12 to the fixture.

Even is a thief removes the cap 20 from the jack plug 10, the thief is unable to operate the locking screw 18 with commonplace tools as commonplace tools cannot achieve purchase on the security formation 76 on the locking screw 18. The configuration of the pin 14 cannot be changed from the locking configuration shown in FIG. 3 to the release configuration shown in FIGS. 2 and 6 without using the security key 80 or a replica of the security key 80.

A potential purchaser of the mobile telecommunications handset 94 may wish to listen to an audio output from the jack socket 96. This is made possible by the anti-theft device because electrical audio signals output by the jack socket 96 of the mobile telecommunications handset 94 are received by the jack plug 10 (when the jack plug 10 is in the locking configuration) and passed along the flexible attachment cable 12 to the audio output socket 88 in the connector 86. Hence, a potential purchaser can plug his or her headphones into the socket 88 and listen to, for example, music output from the mobile telecommunications handset 94. This is illustrated in FIG. 7 which shows the standard jack plug 90 positioned for engagement with the socket 88.

The retailer may remove the mobile telecommunications handset 94 from the anti-theft device by using the security key 80 to unscrew the locking screw 18 to a release position whereupon the pin 14 resumes the release configuration shown in FIGS. 2 and 6. The jack plug 10 may then be withdrawn from the mobile telecommunications handset 94. In most cases, the mobile telecommunications handset 94 will be undamaged by use of the anti-theft device and the anti-theft device can be used again with a different electronic product.

It will be appreciated that the use of the anti-theft device described above gives rise to a number of significant advantages.

Firstly, the jack plug 10 engages with and locks in a standard jack socket 96. This means that the anti-theft device can be used with any electronic product having a compatible standard jack socket.

Secondly, the plug 10 and the flexible attachment cable 12 have a relatively low weight. This means that a potential purchaser can pick up and handle the electronic product and get an accurate impression of the weight and feel of the product. As the anti-theft device does not wrap around the electronic product, the anti theft device does not obstruct the use of buttons on the electronic product or prevent a potential purchaser for feeling how the product fits in his or her hand.

It will be appreciated that an anti-theft device in accordance with the invention may utilise a type of plug other than a jack plug. Preferably, the plug will be adapted to be engaged with and to lock in a socket of standard type commonly found in electronic products.

Figure 8:
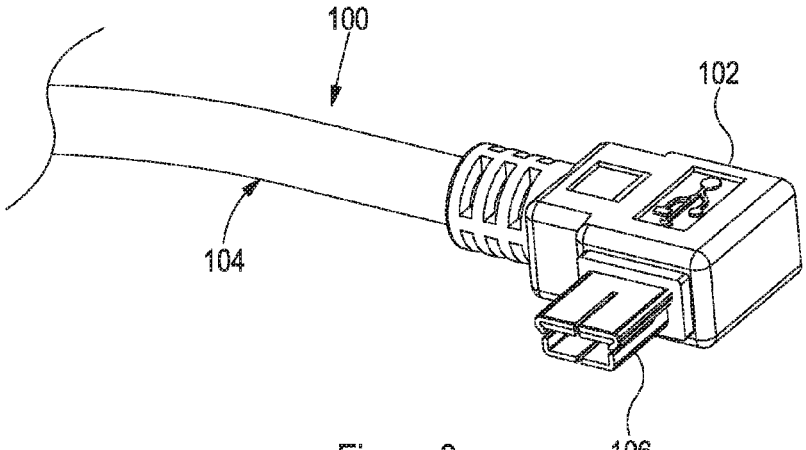
FIG. 8 is a perspective view of a second anti-theft device comprising a plug and a flexible attachment cable.

A second anti-theft device 100 is shown in FIGS. 8 to 11. As best seen in FIG. 8, the second anti-theft device 100 utilises a mini B USB plug 102. The second anti-theft device 100 also has a flexible attachment cable 104.

Figure 9:
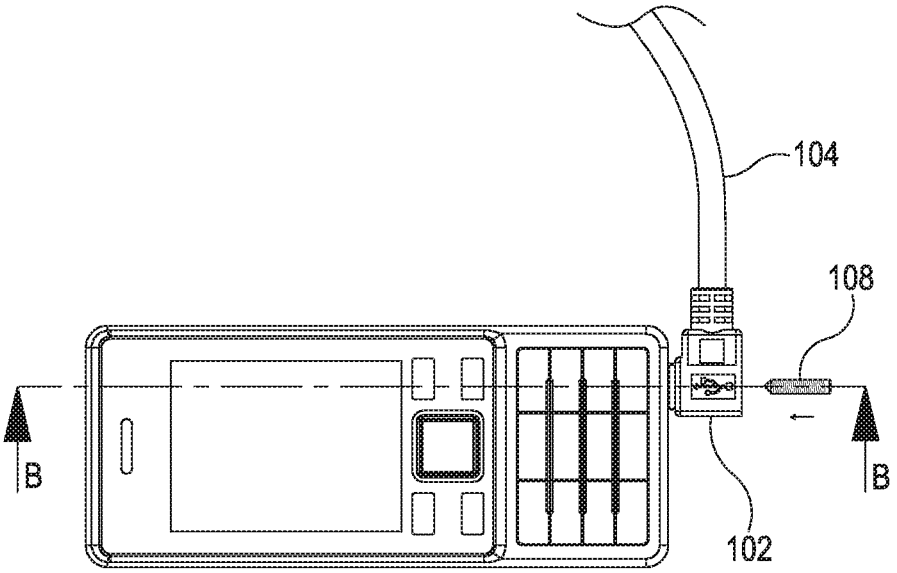
FIG. 9 is a plan view showing the second anti-theft device of FIG. 8 together with a mobile telecommunications handset.
Figure 10:
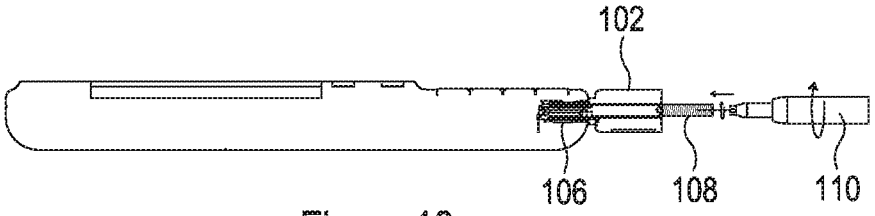
FIG. 10 is a view, partially in cross-section, showing the second anti-theft device and the mobile telecommunications handset of FIG. 9, in a first stage of connection of the anti-theft device to the mobile telecommunications handset.
Figure 11:
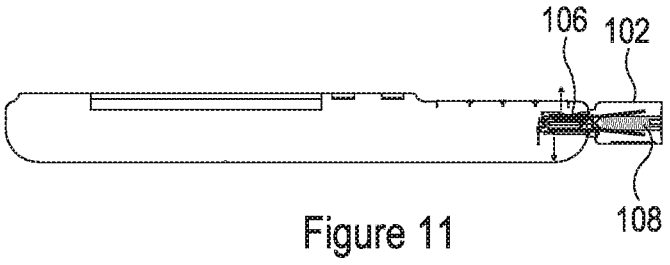
FIG. 11 is a view, partially in cross-section, showing the second anti-theft device and the mobile telecommunications handset of FIGS. 9 and 10, showing the anti-theft device in a second stage of attachment to the mobile telecommunications handset.

As seen in FIGS. 9 to 11, the second anti-theft device 100 works in a similar way to the first anti-theft device described above, with the exception that the USB plug 102 engages with and locks in a standard USB socket in the electronic product. The USB plug 102 also has an insertable portion 106 for inserting into the USB socket in the electronic device. A locking screw 108 can be screwed into the USB plug 102 which causes expansion of the insertable portion 106 which, in turn, causes the insertable portion 106 to jam within and become locked within the USB socket in the electronic product. As for the first anti-theft device described above, a security key 110 is used to operate the locking screw 108 of the USB plug 102 of the second anti-theft device 100.

The USB plug 102 and the flexible attachment cable 104 are adapted to charge the electronic product, via the USB socket of the product, when the flexible attachment cable 104 is electrically connected to a suitable electrical power source. This means that the electronic product does not need to be disconnected from the second anti-theft device 100 for charging.

The USB plug 103 and the flexible attachment cable 104 may also be adapted to input or output information into or out of the electrical product.

Figure 12:
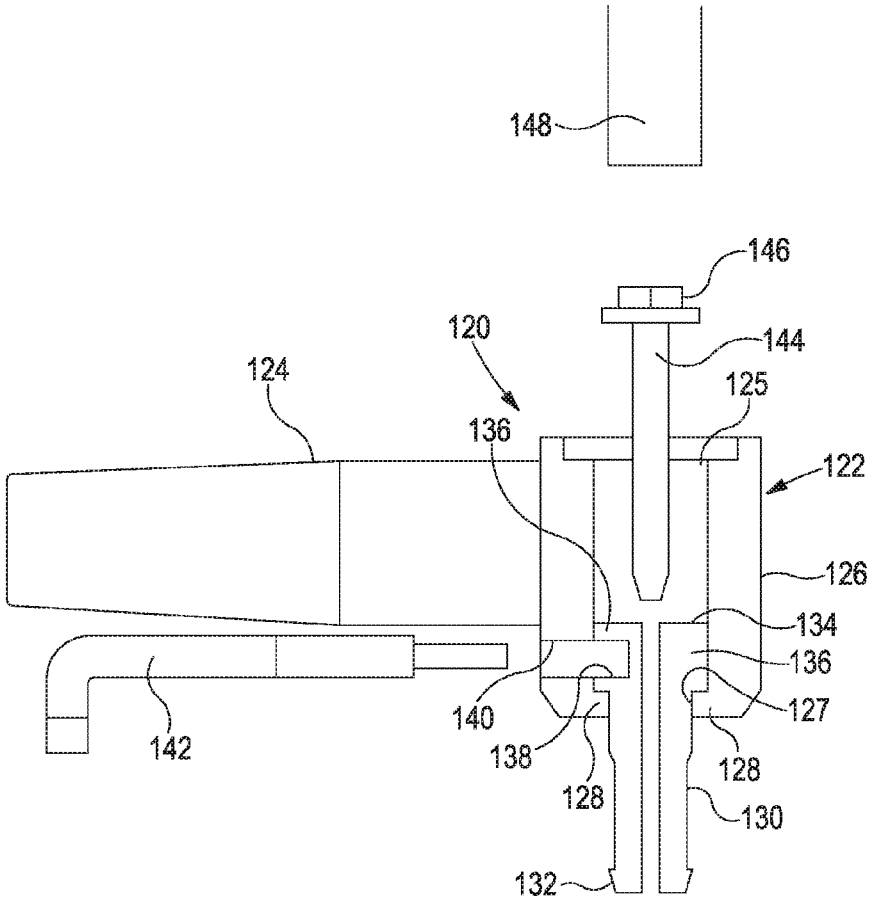
FIG. 12 is a cross-sectional view of a third anti-theft device.

A third anti-theft device 120 is shown in FIG. 12. The third anti-theft device 120 comprises a plug 122 and a flexible attachment cable (not shown). The plug 122 has a generally cylindrical body portion 126 and an annular pin 130. The flexible attachment cable is securely attached to the body portion 126 via an attachment sleeve 124.

The body portion 126 has a first open end 125 and a second open end 127. At the second open end 127, the body portion 126 is provided with an annular flange 128 that extends radially inwardly.

The annular pin 130 has an internal screw thread (not shown), an expandable first locking end 132 and a second end 134. At the second end 134, the pin 130 is provided with a thickened portion 136 with an increased external diameter.

The second end 134 of the pin 130 is received within the interior of the body portion 126 such that the pin 130 extends through the second open end 127 of the body portion 126 and the first locking end 132 of the pin 130 lies outside of the body portion 126. The thickened portion 136 of the pin 130 engages with the annular flange 128 of the body portion 126 to prevent withdrawal of the pin 130 through the second open end 127 of the body portion 126. The arrangement is such that the pin 130 can rotate around its axis relative to the body portion 126.

The body portion 126 is provided with a radially extending through aperture 140 which can be aligned with a radially extending aperture 138 which extends into the thickened portion 136 of the pin 130. The apertures 138, 140 can be aligned with one another by rotating the pin 130 relative to the body portion 126. Both the body portion aperture 140 and the pin aperture 138 are threaded so that a headless screw (not shown) can be screwed into both apertures 138, 140 to lock the pin 130 relative to the body portion 126 to prevent relative rotation therebetween. FIG. 12 shows a key 142 with which the screw can be screwed into and out of the apertures 138, 140.

The plug 122 also includes a locking screw 144 which has an external thread allowing the locking screw 144 to be engaged with the internal screw thread in the interior of the pin 130. The locking screw 144 has a security head 146 which mates with a security key 148 as described above for the other embodiments. When the locking screw 144 is screwed into the pin 130, this expands the expandable first locking end 132 of the pin 130, which in turn locks the pin within a jack socket (not shown) of, for example, a smart phone (not shown).

In order to screw the locking screw 144 into the pin 130 to expand the first locking end 132, it is first necessary to prevent rotation of the pin 130 relative to the body portion 126 using the headless screw and the two apertures 138, 140, as described above. This prevents the pin 130 turning together with the locking screw 144 as the locking screw 144 is turned by the security key 148.

Once the first locking end 132 of the pin 130 is locked within the jack socket of the smart phone, the key 142 can be used to withdraw the headless screw from the aperture 138 in the pin 130 and the aperture 140 in the body portion 126. Once the headless screw has been removed, the pin 130 can rotate relative to the body portion 126. The locking screw 144 rotates together with the pin 130 so that the first locking end 132 remains expanded.

It is advantageous for the pin 130 to be able to rotate relative to the body portion 126 while the pin 130 is locked within the jack socket of the phone. Firstly, as a customer turns the phone around to examine it, the pin 130 and the phone rotate relative to the body portion 126 and this prevents the flexible attachment cable from becoming twisted. Secondly, relative rotation between the pin 130 and the body portion 126 makes it much more difficult to extract the pin 130 from the socket in the phone by force. Any attempt to twist the plug 122 out of the socket by rotating the body portion 126 becomes ineffective as the body portion 126 simply rotates relative to the pin 130 and the phone.

The invention claimed is:

1. An anti-theft device for securing during retail display an electronic product having a jack socket adapted for the transmission of power and/or information during normal post-retail operation of the electronic product, the anti-theft device comprising:

a plug for engagement with the jack socket, the plug having an insertable portion for insertion into the jack socket, the insertable portion having a locking configuration for locking of the insertable portion within the jack socket to prevent removal of the insertable portion from the jack socket while the insertable portion is in the locking configuration and a release configuration for withdrawal of the insertable portion from the jack socket, the plug having a control mechanism for holding the insertable portion in the locking configuration such that when the plug is engaged with the jack socket the configuration of the insertable portion can be changed from the locking configuration to the release configuration substantially only by operation of the control mechanism by a security key; and a flexible attachment for attaching the plug to a fixture;

wherein the plug has a body portion which remains outside of the jack socket and to which the flexible attachment is attached, the insertable portion being rotatable relative to the body portion around an axis when the insertable portion is in the locking configuration in the jack socket, the insertable portion being inserted into the jack socket along the direction of the axis.

2. The anti-theft device according to claim 1, including a locking mechanism to lock the insertable portion relative to the body portion to prevent said relative rotation between the insertable portion and the body portion.

3. The anti-theft device according to claim 2, wherein the plug includes a pin that has a first expandable end and a second end, the insertable portion comprising the first expandable end, the body portion forming a sleeve around the second end of the pin, the second end of the pin having an aperture extending in a direction radial to said axis of rotation, the body portion having an aperture, the aperture in the body portion being alignable with the aperture in the second end of the pin and the locking mechanism comprising a restraining member that is positionable within both said apertures to achieve said locking against rotation of the body portion relative to the insertable portion.

4. The anti-theft device according to claim 1, wherein the insertable portion is adapted for said insertion into and said locking within a standard socket which, in the normal post-retail operation of an electronic product incorporating the socket, serves for one or more functions selected from the group consisting of: charging the electronic product; transmitting information into the electronic product; transmitting information out of the electronic product; and powering the electronic product.

5. The anti-theft device according to claim 1, wherein the control mechanism includes a locking member moveable between a locking position and a release position, the locking member locking the insertable portion in the locking configuration when the locking member is in the locking position.

6. The anti-theft device according to claim 5, wherein the locking member is a screw having a formation for cooperation with the security key to allow the security key to exert a torque on the screw for movement of the screw between the locking and release positions.

7. The anti-theft device according to claim 5, wherein movement of the locking member to the locking position causes an expansion of the insertable portion for jamming of the insertable portion within the socket.

8. The anti-theft device according to any claim 1, wherein the plug is adapted for transmitting information to and/or from the electronic product via the jack socket.

9. The anti-theft device according to claim 1, wherein the plug is adapted for receiving an electrical audio signal from the jack socket of the electronic product, the anti-theft device including an audio socket for outputting the electrical audio signal and electrical conductors for transmitting the electrical audio signal to the audio socket.

10. A kit comprising an anti-theft device according to claim 1 and a security key for said operation of the control mechanism.

11. An assembly comprising an anti-theft device according to claim 1, and an electronic product having a jack socket adapted for the transmission of power and/or information during normal post-retail operation of the electronic product, wherein the insertable portion of the plug is locked within the jack socket.

12. The assembly according to claim 11, wherein the jack socket is a standard socket which, in the normal post-retail operation of the electronic product serves for one or more functions selected from the group consisting of: charging the electronic product, transmitting information into the electronic product; transmitting information out of the electronic product; and powering the electronic product.

13. The assembly according to claim 11, wherein the electronic product is selected from the group consisting of: a mobile telecommunications handset; a portable computing device; and a portable player of digital media.

14. A method of securing against theft during retail display a portable electronic product comprising: providing a portable electronic product having a jack socket adapted for the transmission of power and/or information during normal post-retail operation of the electronic product; engaging a plug with the jack socket; operating the plug to lock the plug in the jack socket; the plug being attached by a flexible attachment to a retail display fixture; wherein the plug has an insertable portion for insertion into the jack socket, the insertable portion having a locking configuration for locking of the insertable portion within the jack socket to prevent removal of the insertable portion from the jack socket while the insertable portion is in the locking configuration and a release configuration for withdrawal of the insertable portion from the socket, said operating of the plug to lock the plug in the jack socket comprising changing the configuration of the insertable portion from the release configuration to the locking configuration; and wherein the plug has a body portion which remains outside of the jack socket and to which the flexible attachment is attached, the insertable portion being rotatable relative to the body portion around an axis when the insertable portion is in the locking configuration in the jack socket, the insertable portion being inserted into the jack socket along the direction of the axis.

15. The method according to claim 14, wherein when the plug is locked in the socket the plug can be withdrawn from the socket substantially only by operating the plug with a security key.

16. The method according to claim 14, wherein the plug includes a locking mechanism to lock the insertable portion relative to the body portion to prevent said relative rotation between the insertable portion and the body portion.

17. The method according to claim 16, wherein the plug includes a pin that has a first expandable end and a second end, the insertable portion comprising the first expandable end, the body portion forming a sleeve around the second end of the pin, the second end of the pin having an aperture extending in a direction radial to said axis of rotation, the body portion having an aperture, the aperture in the body portion being alignable with the aperture in the second end of the pin and the locking mechanism comprising a restraining member that is positionable within both said apertures to achieve said locking against rotation of the body portion relative to the insertable portion.

18. The method according to claim 14, wherein the plug has a control mechanism for holding the insertable portion in the locking configuration such that when the plug is engaged with the jack socket the configuration of the insertable portion can be changed from the locking configuration to the release configuration substantially only by operation of the control mechanism by a security key, said operating of the plug to lock the plug in the socket comprising operating the control mechanism with the security key to change the configuration of the insertable portion from the release configuration to the locking configuration.

19. The method according to claim 14, wherein the socket is a standard socket which, in the normal post-retail operation of the electronic product, serves for one or more functions selected from the group consisting of: charging the electronic product; transmitting information into the electronic product; transmitting information out of the electronic product; and powering the electronic product.

20. The method according to claim 14, further including transmitting information into or out of the electronic product via the jack socket and the plug.

21. The method according to claim 20, wherein the information is an electrical audio signal that is received from the jack socket of the electronic product by the plug, and including conveying the electrical audio signal to an output socket.

22. The method according to claim 14, wherein the electronic product is selected from the group consisting of: a mobile telecommunications handset; a portable computing device; and a portable player of digital media.

23. An assembly comprising: a portable electronic product having a jack socket adapted for the transmission of power and/or information during normal post-retail operation of the electronic product; a plug engageable with the jack socket, the plug being operable to lock the plug in the jack socket; and a flexible attachment for attaching the plug to a fixture; wherein the plug has an insertable portion for insertion into the jack socket, the insertable portion having a locking configuration for locking of the insertable portion within the jack socket to prevent removal of the insertable portion from the jack socket while the insertable portion is in the locking configuration and a release configuration for withdrawal of the insertable portion from the jack socket; and wherein the plug has a body portion which remains outside of the jack socket and to which the flexible attachment is attached, the insertable portion being rotatable relative to the body portion around an axis when the insertable portion is in the locking configuration in the jack socket, the insertable portion being inserted into the jack socket along the direction of the axis.

24. The assembly according to claim 23, wherein when the plug is locked in the jack socket the plug can be withdrawn from the jack socket substantially only by operating the plug with a security key.

25. The assembly according to claim 23, including a locking mechanism to lock the insertable portion relative to the body portion to prevent said relative rotation between the insertable portion and the body portion.

26. The assembly according to claim 25, wherein the plug includes a pin that has a first expandable end and a second end, the insertable portion comprising the first expandable end, the body portion forming a sleeve around the second end of the pin, the second end of the pin having an aperture extending in a direction radial to said axis of rotation, the body portion having an aperture, the aperture in the body portion being alignable with the aperture in the second end of the pin and the locking mechanism comprising a restraining member that is positionable within both said apertures to achieve said locking against rotation of the body portion relative to the insertable portion.

27. The assembly according to claim 23, wherein the plug has a control mechanism for holding the insertable portion in the locking configuration such that when the plug is engaged with the jack socket the configuration of the insertable portion can be changed from the locking configuration to the release configuration substantially only by operation of the control mechanism by a security key.

28. The assembly according to claim 23, wherein the jack socket is a standard socket which, in the normal operation of the electronic product, serves for one or more functions selected from the group consisting of: charging the electronic product; transmitting information into the electronic product; transmitting information out of the electronic product; and powering the electronic product.

29. The assembly according to claim 23, wherein the plug is adapted for transmitting information into or out of the electronic product via the jack socket.

30. The assembly according to claim 29, further including an audio output socket provided on the plug or on the flexible attachment, wherein the plug is adapted for receiving an electrical audio signal from the jack socket of the electronic product, and including electrical conductors for conveying the electrical audio signal to the audio output socket.

31. The assembly according to claim 23, wherein the electronic product is selected from the group consisting of: a mobile telecommunications handset; a portable computing device; and a portable player of digital media.

* * * * *